United States Patent [19]

Ikeda et al.

[11] 4,232,993

[45] Nov. 11, 1980

[54] LOW PRESSURE CASING FOR A STEAM TURBINE

[75] Inventors: Tadasu Ikeda; Takamitsu Taki, both of Hitachi, Japan

[73] Assignee: Hitachi, Ltd., Japan

[21] Appl. No.: 911,925

[22] Filed: Jun. 2, 1978

[30] Foreign Application Priority Data

Jun. 13, 1977 [JP] Japan ..... 52/68887

[51] Int. Cl.[3] ..... F01D 3/02; F01D 25/26; F01D 25/08

[52] U.S. Cl. ..... 415/103; 415/134; 415/177; 415/219 R

[58] Field of Search ..... 415/101, 103, 134, 177, 415/219 R

[56] References Cited

U.S. PATENT DOCUMENTS 4,102,598 7/1978 Stock et al. ..... 415/219 R

*Primary Examiner*—Leonard E. Smith

*Attorney, Agent, or Firm*—Craig & Antonelli

[57] ABSTRACT

A low pressure casing structure of a single shell type which houses, in a low pressure casing, a turbine rotor having turbine blades mounted thereon in a multiplicity of stages, including a heat admitting portion located in an upper central part of the low pressure casing and formed therein with a steam admitting port for admitting turbine driving steam therethrough into the interior of the casing, turbine diaphragms rigidly secured to an inner surface of the casing for supporting stationary blades arranged in a multiplicity of stages axially of the turbine in association with the turbine blades of the turbine rotor, exhausted steam chambers each located at one of opposite ends of the casing axially of the turbine for receiving steam of low temperature and low pressure exhausted thereinto after doing work in the turbine, and a shell of the casing connecting the steam admitting portion to the exhausted steam chambers. The low pressure casing of a single shell type further includes wall means located along an outer surface of the shell in a manner to enclose same and cooperate therewith to define therebetween annular spaces for minimizing temperature differential between the inner and outer surfaces of the low pressure casing.

4 Claims, 3 Drawing Figures

LOW PRESSURE CASING FOR A STEAM TURBINE

This invention relates to steam turbines in general and more particularly to a low pressure casing structure of a single shell type for a steam turbine which is provided with means for minimizing temperature differential between inner and outer surfaces of the low pressure casing structure.

It has hitherto been customary to build a low pressure casing for a steam turbine in a double shell structure wherein the casing includes an inner cylindrical portion and an outer cylindrical portion. However, there has in recent years been a growing demand for steam turbines of compact size and low cost. This demand has led to the advent of a low pressure casing of a single shell type, as disclosed in U.S. Pat. No. 3,594,095, for example. This type of low pressure casing includes a steam admitting portion disposed in the center of the casing and connected to a crossover conduit for admitting turbine driving steam of high temperature and high pressure into the low pressure casing which has rigidly secured to an inner surface of its shell turbine diaphragms and diaphragm supports for supporting the turbine diaphragm and which has reinforcing ribs attached to an outer surface thereof. The casing further includes exhausted steam chambers each located at one of opposite ends of the casing axially of the turbine for receiving steam exhausted thereinto after doing work in the turbine.

In this type of low pressure casing of single shell construction, steam of high temperature and high pressure flows through the steam admitting portion and the shell of the casing. Since the shell is maintained in contact with atmosphere at its outer surface, there is a considerably high pressure differential between the inner and outer surfaces of the shell. Thus the reinforcing ribs are attached in a plurality of numbers to the outer surface of the shell of the casing to increase the rigidity of the shell of the casing. However, in spite of the provision of the reinforcing ribs, it has been unavoidable that various parts of the steam admitting portion and the shell of the casing undergo thermal deformation due to the aforesaid temperature differential. In particular, a low pressure casing of the type described has had the disadvantage that a high degree of thermal deformation and thermal stresses develop in the vicinity of the weld joining the steam admitting portion to the shell of the casing.

On the other hand, the diaphragm supports for supporting the turbine diaphragms are rigidly joined by welding to the shell of the casing. Therefore, when deformation develops in the vicinity of the weld joining the steam admitting portion to the shell of the casing, this deformation directly influences the diaphragm supports and causes deformation to develop therein, which in turn causes changes to occur in the axial gaps and the radial gaps between the moving blades of the turbine rotor and the turbine diaphragms supported by the diaphragm supports. As a result, the turbine shows a reduction in efficiency or the turbine diaphragms and the moving blades are damaged in portions thereof in which they are brought into sliding engagement with one another.

This invention has an its object the provision of a low pressure casing of a single shell type which is capable of minimizing temperature differential which would occur between inner and outer surfaces of the low pressure casing so as to avoid thermal deformation of the casing.

The outstanding characteristic of the invention resides in the provision of a novel low pressure casing structure of a single shell type for a steam turbine. According to the invention, there is provided wall means for use in a low pressure casing of a single shell type for a steam turbine which houses a turbine rotor in the interior thereof and comprises a steam admitting portion for admitting turbine driving steam therethrough into the interior of the casing, turbine diaphragms rigidly secured to an inner surface of the casing and arranged axially of the turbine in a multiplicity of stages, exhausted steam chambers each located at one of opposite ends of the casing axially of the turbine for receiving steam of low temperature and low pressure exhausted thereinto after doing work in the turbine, and a shell connecting the steam admitting portion to the exhausted steam chambers. The wall means is located along an outer surface of the shell in a manner to enclose same and cooperate therewith to define therebetween spaces for minimizing temperature differential between the inner and outer surfaces of the low pressure casing, thereby minimizing deformation of the casing.

One embodiment of the low pressure casing of a single shell type in conformity with the invention will now be described by referring to the accompanying drawings.

Figure 1:
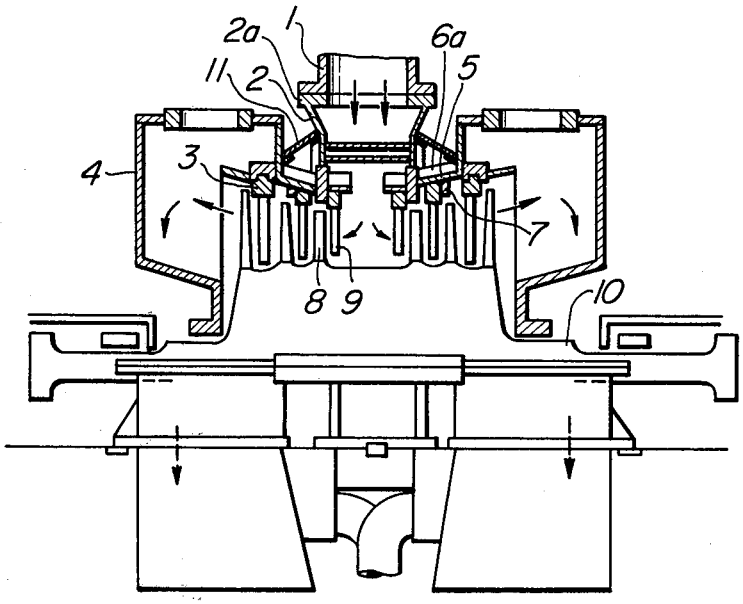
FIG. 1 is a sectional view of the low pressure casing of a single shell type for a steam turbine, taken along the axis of the turbine, which incorporates therein the novel feature of the invention and comprises one embodiment thereof.

In FIG. 1, a crossover conduit 1 for passing steam of high temperature and high pressure therethrough from a high pressure turbine, not shown, is connected to a steam admitting port 2*a* of a steam admitting portion 2 formed in an upper central part of the low pressure casing for admitting the steam of high temperature and high pressure into the interior of the low pressure casing as turbine driving steam. The low pressure casing includes a single casing shell 5 located in the central portion of the casing in which is located a turbine rotor having a turbine shaft 10 mounting moving blades 8 thereon in a multiplicity of stages. Rigidly secured to an inner surface of the casing shell 5 and arranged axially of the turbine in a multiplicity of stages are turbine diaphragms 3 having stationary blades 9 and diaphragm supports 7 for supporting the turbine diaphragms 3. A plurality of reinforcing ribs 6*a* are attached axially of the turbine to an upper surface of the casing shell 5. Exhausted steam chambers 4 are each located at one of opposite ends of the casing shell 5 axially of the turbine for receiving steam of low temperature and low pressure exhausted thereinto after doing work in the low pressure turbine.

Figure 2:
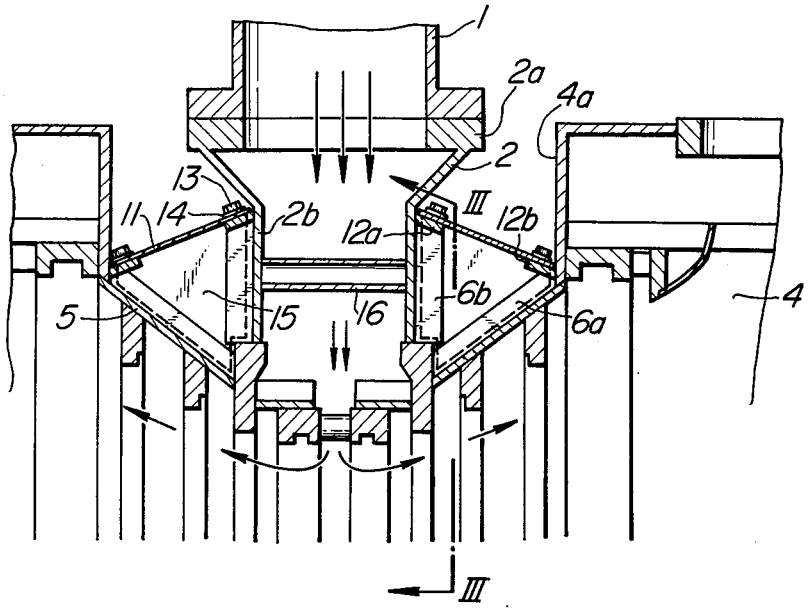
FIG. 2 is a fragmentary sectional view, on an enlarged scale, showing in detail the essential portions of the low pressure casing shown in FIG. 1.

As shown in FIG. 2, a plurality of reinforcing ribs 6*b* are attached to an outer surface of a wall 2*b* of the steam admitting portion 2 and arranged radially of the turbine. Each of the reinforcing ribs 6*b* has a circularly arcuate support 12*a* welded to an outer end thereof. Each of the reinforcing ribs 6*a* attached to the outer surface of the casing shell 5 also has a circularly arcuate support 12*b* welded to its outer end as viewed axially of the turbine and projects outwardly of an end wall 4*a* of each exhausted steam chamber 4. Each of the supports 12*a* and 12*b* is formed therein with threaded holes for threadably fitting therein bolts 13 for securing each support. Temperature differential absorbing rings 11 of a frusto-conical shape formed of a thin sheet of several millimeters in thickness for enclosing the outer surface of the casing shell 5 is each formed with large diameter holes 11*a* at opposite ends thereof as viewed axially of the turbine for loosely receiving the bolts 13 thereinto. Each temperature differential absorbing ring 11 is bolted in place by positioning the opposite ends thereof, as viewed axially of the turbine, against outer surface of the supports 12*a* and 12*b* respectively, loosely inserting the bolts 13 with washers 14 into the large diameter holes 11*a* formed in the ring 11, and threadably fitting the bolts 13 in the threaded holes formed in the supports 12*a* and 12*b*. Reinforcing tubes 16 are mounted within the stream admitting portion 2.

If the temperature differential absorbing rings 11 are mounted in this manner, annular spaces 18 are formed between inner surfaces of the rings 11 and the outer surface of the casing shell 5. Owing to the presence of the annular spaces 18, the outer surfaces of the wall 2*b* of the steam admitting portion 2 and the shell 5, which constitute the casing, are kept from being brought into direct contact with atmosphere of low temperature. This reduces temperature differential between the outer and inner surfaces of the casing, thereby reducing thermal stresses and thermal deformation developing in the casing. As aforesaid, since the bolts 13 are loosely inserted in the large diameter holes 11*a* formed in the temperature differential absorbing rings 11, deformation of the casing which might develop either axially or radially of the turbine can be accommodated by the gaps between the bolts 13 and the walls of the large diameter holes 11*a*.

A plurality of partition plates 15 are connected at one end thereof to the inner surface of each temperature differential absorbing ring 11 and extend radially of the turbine so as to divide each annular space 18 into a plurality of sections. By this arrangement, it is possible to prevent development of convection within the annular spaces 18 and to equalize temperature differential between the steam of high temperature and high pressure admitted into the casing and the air inside the annular spaces 18 along the entire circumference of the casing shell 5. This is conductive to minimization of development of thermal stresses in the casing due to temperature differential between various parts thereof.

Figure 3:
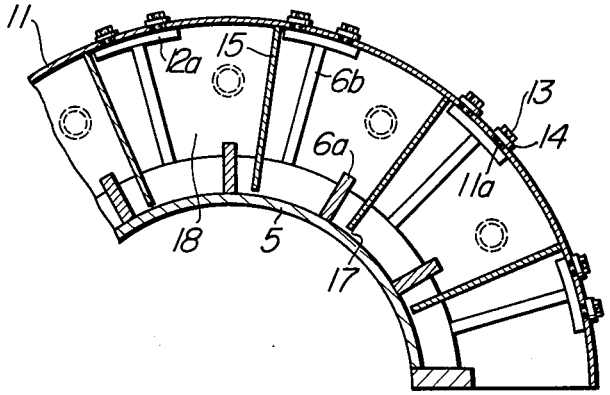
FIG. 3 is a fragmentary sectional view, as viewed in the direction of arrows III—III in FIG. 2.

As shown in FIGS. 2 and 3, clearances 17 are formed between the partition plates 15 at the other end thereof and the outer surfaces of the casing shell 5 and the wall 2*b* of the steam admitting portion 2, so that the adjacent sections of each space 18 can be maintained in communication with one another. By this arrangement, direct transfer of heat from the outer surface of the casing shell 5 or the wall 2*b* of the steam admitting portion 2 to the partition plates 15 can be avoided. The clearances 17 also perform the function of gradually changing temperature differential between the sections of each annular space 18 formed by dividing the latter by the partition plates 15.

From the foregoing description, it will be appreciated that the present invention provides temperature differential absorbing rings located along the outer surface of the shell of the casing in a manner to enclose the latter and cooperate therewith to define therebetween spaces which are annular in shape. This arrangement has the effect of minimizing temperature differential between the outer and inner surfaces of the casing shell and preventing thermal deformation and thermal stresses developing in the casing. Thus it is possible to prevent changes in the gaps between the stationary blades and moving blades which might otherwise occur due to displacement of the turbine diaphragms caused by thermal deformation of the casing and to avoid damage which might otherwise be caused to portions of these blades which might be brought into sliding contact with one another. It will be appreciated that the present invention enables full realization of the advantages from the use of a low pressure casing of a single shell type which is markedly more advantageous than a low pressure casing of a double shell type in points of cost and weight, because the low pressure casing of a single shell type incorporating therein the features of the invention is high in stability of performance and free from the danger of reduced efficiency in operation.

What is claimed is:

1. A low pressure casing of a single shell type for a steam turbine which houses a turbine rotor therein, comprising:

steam admitting means located in an upper central part of said casing and formed therein with a steam admitting port for admitting turbine driving steam therethrough into the interior of said casing;

turbine diaphragm means rigidly secured to an inner surface of said casing for supporting stationary blades arranged in a multiplicity of stages axially of the turbine;

exhausted steam chamber means disposed at opposite ends of said casing axially of the turbine for receiving steam of low temperature and low pressure exhausted thereinto after doing work in the turbine; and shell means of the casing connecting said steam admitting means to said exhausted steam chamber means;

wherein the improvement comprises:

wall means enclosing an outer periphery of the shell means of said casing and connected at its end to said steam admitting means and said exhausted steam chamber means, temperature moderating spaces being defined between an inner surface of said wall means and an outer surface of the shell means of the casing, whereby the temperature differential produced between the outer and inner surfaces of the shell means of the casing can be minimized, and wherein said wall means comprises rings which are frusto-conical in shape and have a larger diameter at one end thereof which is disposed near said steam admitting means than at the other end thereof which is disposed remote from said steam admitting means.

2. A low pressure casing of a single shell type for a steam turbine which houses a turbine rotor therein, comprising:

steam admitting means located in an upper central part of said casing and formed therein with a steam admitting port for admitting turbine driving stream therethrough into the interior of said casing;

turbine diaphragm means rigidly secured to an inner surface of said casing for supporting stationary blades arranged in a multiplicity of stages axially of the turbine;

exhausted steam chamber means disposed at opposite ends of said casing axially of the turbine for receiving steam of low temperature and low pressure exhausted thereinto after doing work in the turbine; and shell means of the casing connecting said steam admitting means to said exhausted steam chamber means;

wherein the improvement comprises:

wall means enclosing an outer periphery of the shell means of said casing and connected at its ends to said steam admitting means and said exhausted steam chamber means, temperature moderating spaces being defined between an inner surface of said wall means and an outer surface of the shell means of the casing, whereby the temperature differential produced between the outer and inner surfaces of the shell means of the casing can be minimized, and wherein said wall means has a plurality of partition plates rigidly secured to an inner surface thereof for peripherally partitioning each of said spaces into a plurality of sections.

3. A low pressure casing as claimed in claim 2, wherein said partition plates are spaced apart at forward ends thereof from the outer surface of said shell means whereby the adjacent sections of each of said spaces can be maintained in communication with one another.

4. A low pressure casing as claimed in claim 2, wherein said partition plates are arranged radially.

* * * * *